US006005191A

United States Patent [19]

Tzeng et al.

[11] Patent Number: 6,005,191

[45] Date of Patent: Dec. 21, 1999

[54] HEAT-SHRINKABLE JACKET FOR EMI SHIELDING

[75] Inventors: Wen-Shian V. Tzeng, Reading, Mass.; Ronald Saccuzzo, Salem, N.H.; Jonathan E. Mitchell, Cambridge, Mass.

[73] Assignee: Parker-Hannifin Corporation, Cleveland, Ohio

[21] Appl. No.: 08/792,913

[22] Filed: Jan. 21, 1997

Related U.S. Application Data

[60] Provisional application No. 60/016,684, May 2, 1996.

[51] Int. Cl.[6] ..... H01B 7/18

[52] U.S. Cl. ..... 174/102 R; 174/36; 174/DIG. 8; 174/103; 174/110 N

[58] Field of Search ..... 174/36, DIG. 8, 174/102 R, 103, 110 N, 110 P, 106 R

[56] References Cited

U.S. PATENT DOCUMENTS

| | | | |
|---|---|---|---|
| 3,576,387 | 4/1971 | Derby | 174/36 |
| 4,090,897 | 5/1978 | Minick | 156/73.1 |
| 4,376,229 | 3/1983 | Maul et al. | 174/35 R |
| 4,555,422 | 11/1985 | Nakamura et al. | 428/34.9 |
| 4,639,545 | 1/1987 | Pithouse et al. | 174/36 |
| 4,684,762 | 8/1987 | Gladfelter | 174/36 |
| 4,915,139 | 4/1990 | Landry et al. | 138/125 |
| 5,015,800 | 5/1991 | Vaupotic et al. | 174/34 |
| 5,043,530 | 8/1991 | Davies | 174/36 |
| 5,106,437 | 4/1992 | Lau et al. | 156/51 |
| 5,293,001 | 3/1994 | Gebs | 174/36 |
| 5,477,011 | 12/1995 | Singles et al. | 174/102 R |
| 5,483,020 | 1/1996 | Hardie et al. | 174/36 |

FOREIGN PATENT DOCUMENTS

| | | |
|---|---|---|
| 0 402 046 | 12/1990 | European Pat. Off. . |
| 22023110A | 5/1990 | Japan . |
| 06218873A | 9/1994 | Japan . |

*Primary Examiner*—Dean A. Reichard
*Assistant Examiner*—William H Mayo, III
*Attorney, Agent, or Firm*—John A. Molnar, Jr.

[57] ABSTRACT

A heat-shrinkable electromagnetic interference (EMI) shielding jacket sheathable over a generally elongate object of a given outer diameter extent. The jacket is formed of a tubular outer member of an indefinite length and an expanded inner diameter which is greater than the outer diameter of the object, an electrically-conductive inner member received coaxially within the outer member and extending coextensive therewith, and a generally continuous, thermoplastic interlayer interposed between the outer and inner members and extending coextensive therewith. The interlayer bonds the inner member to the outer member along substantially the entire length thereof for consolidating the jacket into an integral structure. The outer member, in turn, is heat-shrinkable to a recovered, i.e., contracted inner diameter smaller than the expanded inner diameter for substantially conforming the jacket to the outer diametric extent of the object.

5 Claims, 1 Drawing Sheet

HEAT-SHRINKABLE JACKET FOR EMI SHIELDING

This application claims benefit of U.S. Provisional Application(s) No. 60/016,684 filed May 2, 1996.

BACKGROUND OF THE INVENTION

The present invention relates broadly to electromagnetic interference (EMI) shielding, and more particularly to a heat-shrinkable sheathing or other jacket for shielding a wire, cable, data or signal line, antenna, or other electrical conductor or elongate article.

The operation of electronic devices such as computers, business machines, communications equipment, and the like is attended by the generation of electromagnetic radiation within the electronic circuitry and transmission lines of the equipment. As is detailed in U.S. Pat. Nos. 5,202,536; 5,142,101; 5,105,056; 5,028,739; 4,952,448; and 4,857,668, such radiation often develops as a field or as transients within the radio frequency band of the electromagnetic spectrum, i.e., between about 10 KHz and 10 GHz, and is termed "electromagnetic interference" or "EMI" as being known to interfere with the operation of other proximate electronic devices.

To attenuate EMI effects, shielding having the capability of absorbing and/or reflecting EMI energy may be employed both to confine the EMI energy within a source device, and to insulate that device or other "target" devices from other source devices. In this regard, the shielding is provided as a barrier which is inserted between the source and the other devices. For the electronic device itself, the shielding typically is configured as an electrically conductive and grounded housing which encloses the device. For the electrical wire, cable, cord, or other conductor which supplies power to the device or transmits signals to or from the device, shielding has been provided in a similar manner by enclosing the conductor within an electrically conductive conduit or other housing.

A more flexible and less cumbersome shielding has been provided by sheathing the conductor, which typically includes an inner conductive core and an outer layer of an electrically-insulating, dielectric material, within a tubular shielding layer woven or braided of a metal wire or other electrically-conductive fiber. For example, Hardie et al., U.S. Pat. No. 5,483,020 discloses a parallel pair cable for high data signal transmission. The cable has a pair of parallel conductors which are surrounded by an insulating dielectric layer. The dielectric, in turn, is surrounded by a braided metal shield of a plated electrical conductor, which shield itself may be covered with an optional jacket.

Singles et al., U.S. Pat. No. 5,477,011 discloses a low-noise signal transmission cable which employs an insulative layer that is bonded to a surrounding shield layer via an adhesive. The shield may be a braided metal, conductive polymer, or wrapped foil layer.

Gebs, U.S. Pat. No. 5,293,001 discloses a flexible, shielded cable assembly. The assembly includes a flexible metal conductor, a dielectric layer positioned about the conductor, and a flexible metallic shield disposed about the dielectric. The shield preferably employs a thin metallic foil and a metallic braid, ribbon, or tape disposed about the foil.

Davies, U.S. Pat. No. 5,043,530 discloses a shield cable which includes an internal conductive core with 1–4 wire leads, each of which are insulated with a wrapping of an insulative tape. The voids between the leads are filled with an amorphous elastomer. A shield layer is provided by braiding a silver-copper alloy wire over the elastomer-covered conductive core. The strands of the shield become embedded in the elastomeric material which thereby fills the spaces in the braided structure. A barrier of an insulative jacket surrounds the elastomer-covered shield and conductive core.

Vaupotic et al., U.S. Pat. No. 5,015,800 discloses a controlled impedance transmission line which consists of a flexible cable having a side-by-side pair of conductors. The conductors are surrounded by respective inner and outer dielectric layers. A braided wire shield surrounds the dielectric layers, which shield, in turn, is surrounded and penetrated by an exterior jacket.

Pithouse et al., U.S. Pat. No. 4,639,545 discloses a conductor which is surrounded by a dielectric. A fabric in the form of a tubular sleeve is woven or positioned around the conductor. The fabric may include a conductive metal warp and a recoverable polymeric weft, which weft is recovered to secure the fabric through engagement with the dielectric.

Maul et al., U.S. Pat. No. 4,376,229 discloses a flexible, shielded electrical conduit. The conduit includes a flexible tubing, a flexible electrical shielding disposed within the tubing, and an axially compressed, radially expanded elastic woven retainer which forces the shielding into continuous contact with the tubing. The shielding may be provided as a weave of electrically conductive filaments.

More recently, proposals have been made to provide shielding for wires, cables, lines, and the like in the form of a tubular, heat-shrinkable outer layer within which is received a conductive inner layer. For example, Derby, U.S. Pat. No. 3,576,387 discloses a heat-shrinkable shield formed of an outer layer of a heat-shrinkable tubing having an thin layer of a metal-filled polymeric matrix bonded to the inner surface thereof. The shield may be sheathed over an insulated wire or cable, and then heated to shrink the outer layer of the shield over the insulation of the wire or cable.

Lau et al., U.S. Pat. No. 5,106,437 discloses a conformable electromagnetic radiation suppression cover for a reflecting structure. The cover includes a tubular outer layer of an electromagnetic radiation absorber formed of a non-conductive composite with one or more kinds of dissipative particles dispersed in a shrinkable dielectric binder. An inner sealant layer is employed to fill any voids between the absorber and the structure. A thin metallic foil may be bonded between the sealant and the absorber as a ground plane.

Nakamura et al., U.S. Pat. No. 4,555,422 discloses a magnetic shielding article which includes a heat-shrinkable outer layer of a thermoplastic polymeric material and an inner layer of a magnetic shielding layer. The shielding layer may be formed of a thermoplastic material filled with a powdered ferrite.

Landry et al., U.S. Pat. No. 4,915,139 discloses a another heat-shrinkable tubing article. Such article is formed of an outer layer of a tubular, heat-deformable material having a thermoplastic melt liner which is bonded to the inner surface thereof. A fiber reinforcement layer is disposed between the melt liner and the shrink tubing.

A representative commercial heat-shrinkable tubing shielding is marketed under the name "CHO-SHRINK™" by the Chomerics Division of Parker-Hannifin Corp., Woburn, Mass. The shielding is formed by coating a conductive compound onto the outer surface of a heat-shrinkable tube. Another such product is manufactured by Raychem Corp., Menlo Park, Calif., as a heat-shrinkable tube electroplated with an outer layer of a conductive metal.

The above-described references and products have garnered acceptance for general use, and heretofore have constituted the state of the art with respect to the EMI shielding of wires, cables, data or signal lines, antennas, electrical conductors, and the like. It will be appreciated, however, that continued improvements in such shields would be well-received by the electronics industry. A preferred shielding would be of low cost and economical to manufacture, and would provide a uniform surface which resists cracking and other mechanical damage within rigorous service environments.

BROAD STATEMENT OF THE INVENTION

The present invention is directed to an electromagnetic interference (EMI) shielding jacket formed of a tubular, heat-shrinkable outer member, and a inner fiber mesh shielding member which may be woven, braided, knitted, or wound of an metal wire or other conductive fiber. In providing for the interposition of an interlayer of a thermoplastic which is heat-deformable to uniformly bond the outer and inner members, the present invention affords an EMI shielding for wires, cables, data or signal lines, antennas, and other electrical conductors and elongate articles which is low-cost and economical to manufacture, but which provides a uniform shielding surface which resists cracking or other mechanical damage. Advantageously, during the heating of the interlayer to bond the inner and outer members, the heat-shrinkable outer member may be partially constricted radially to further consolidate and maintain the integrity of the inner mesh member. The result is an integral shielding structure which may be readily sheathed over any generally elongate article, and which may be cut, sectioned, or otherwise terminated anywhere along its length without the fraying, splaying, or unraveling of the mesh member.

It therefore is a feature of the present invention to provide a heat-shrinkable electromagnetic interference (EMI) shielding jacket which is sheathable over a generally elongate object of a given outer diameter extent. The jacket is formed of a tubular outer member of an indefinite length and an expanded inner diameter which is greater than the outer diameter of the object, an electrically-conductive inner member received coaxially within the outer member and extending coextensive therewith, and a generally continuous, thermoplastic interlayer interposed between the outer and inner members and extending coextensive therewith. The interlayer bonds the inner member to the outer member along substantially the entire length thereof for consolidating the jacket into an integral structure. The outer member, in turn, is heat-shrinkable to a recovered, i.e., contracted, inner diameter smaller than the expanded inner diameter for substantially conforming the jacket to the outer diametric extent of the object.

It is a further feature of the invention to provide a generally elongate object of a given outer diametric extent with an electromagnetic interference (EMI) shielding. In this regard, the object is sheathed within a heat-shrinkable jacket which is formed of a tubular outer member of an indefinite length and an expanded inner diameter which is greater than the outer diameter of the object, an electrically-conductive, tubular inner member received coaxially within the outer member and extending coextensive therewith, and a generally continuous, thermoplastic interlayer interposed between the outer and inner members and extending coextensive therewith. The interlayer bonds the inner member to the outer member along substantially the entire length thereof for consolidating the jacket into an integral structure. With the object sheathed within the jacket so formed, the jacket then is heated to a temperature sufficient to contract the outer member thereof to a recovered, i.e., contracted, inner diameter smaller than the expanded inner diameter substantially conforming the jacket to the outer diametric extent of the object.

It is yet further feature of the invention to provided a method of making a heat-shrinkable electromagnetic interference (EMI) shielding jacket which is sheathable over a generally elongate object of a given outer diametric extent. The jacket is formed by sheathing a thermoplastic interlayer over an electrically-conductive, tubular inner member of an indefinite, and then sleeving a tubular outer member over the interlayer. The outer member is provided as having an expanded diameter which is greater than the outer diameter of the object and as being heat-shrinkable to a recovered, i.e., contracted, inner diameter smaller than the expanded inner diameter substantially conforming the jacket to the outer diametric extent of the object. To bond the inner member to the outer member along substantially the entire length of the inner member, the jacket is heated to a temperature sufficient to melt the interlayer along substantially the entire length of the inner member, and then is cooled to a temperature sufficient to solidify the interlayer.

Advantages of the present invention include the provision of a heat-shrinkable EMI shielding jacket having an outer heat-shrinkable tubing member and an inner consolidated fiber mesh shielding member, the integrity of which is maintained when the jacket is sectioned into a determinable length. Additional advantages include an EMI shielding jacking having a thermoplastic interlayer which may be heated to bond the inner and outer members for presenting a uniform shielding surface along the length of the jacket which can withstand rigorous service environments. Still further advantages include an EMI shielding jacket which may be fabricated using relatively inexpensive components without the need for extensive surface preparations. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
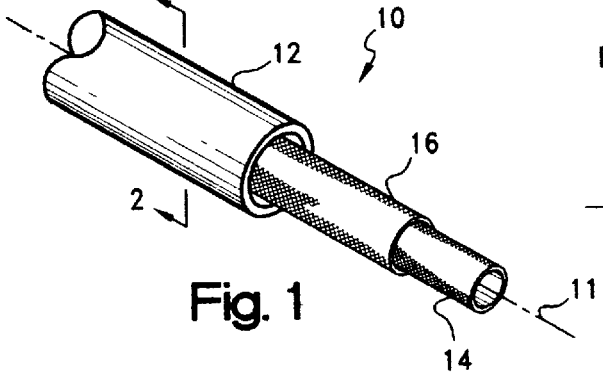
FIG. 1 is a perspective cut-a-way view of an electromagnetic interference (EMI) shielding jacket fabricated in accordance with the present invention as formed of a tubular outer member having an expanded inner diameter, an electrically-conductive member received coaxially within the outer member, and a generally continuous, thermoplastic interlayer interposed between the outer and inner members.
Figure 5:
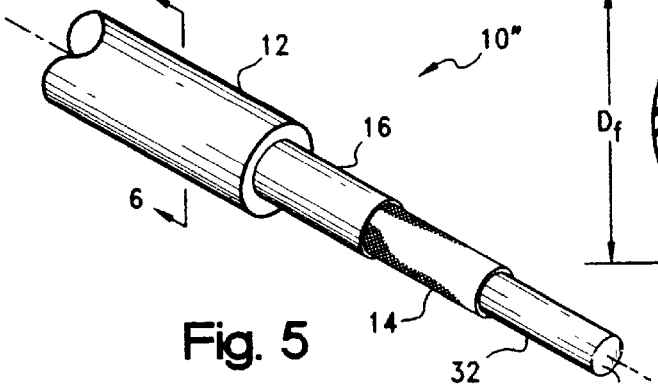
FIG. 5 is a perspective cut-a-way view of the EMI shielding jacket of FIG. 3 shown as having been sheathed over a generally elongate object and heated to a temperature sufficient to contract the outer member of the jacket to a recovered inner diameter substantially conforming the jacket to the outer diametric extent of the object.

Referring to the drawings wherein corresponding reference characters indicate corresponding elements throughout the figures, shown generally at 10 in FIG. 1 is an electromagnetic interference (EMI) shielding jacket according to the present invention as adapted for sheathing a generally elongate object such as a power wire or cable, a data, signal, or other transmission line, an antenna, or another electrical conductor or the like (FIG. 5). For illustrative purposes of the discourse which follows, jacket 10 is shown as extending along a central longitudinal axis, 11, thereof to an indefinite length which may cut, sectioned, or otherwise terminated for sizing to the corresponding lengthwise extent of the object to be shielded. Looking additionally to FIG. 2, jacket 10 is shown in cut-away (FIG. 1) and in cross-section (FIG. 2) to include a tubular, heat-shrinkable outer member, 12, of an expanded inner diameter which is greater than the outer diameter of the object to be shielded, an electrically-conductive inner member, 14, received coaxially within the outer member and extending coextensive therewith, and a generally continuous, thermoplastic interlayer, 16, interposed between the outer and inner members and likewise extending coextensive therewith.

In accordance with the precepts of the present invention, outer member 12 is provided to be heat-shrinkable to a recovered inner diameter smaller than its expanded inner diameter for substantially conforming the jacket to the outer diametric extent of the object to be shielded. That is, in its most preferred form, outer member 12 is extruded or molded as a sleeve or other tube which is stretched or otherwise constructed using conventional techniques such that it is adapted to constrict in the presence of an applied heat source from an original or expanded inner diameter, referenced generally at $D_o$ in FIG. 2, to a contracted minimum or final inner diameter, referenced generally at $D_f$ in FIG. 6. The ratio of $D_o/D_f$ defines a shrink ratio, $S_r$, which preferably is from about 1–10. The original inside diameter $D_o$ of outer member 12 may vary over a wide range depending upon the particular application envisioned, but generally will be about 1 inch or less for wire and cable applications, and about 4 inches or less where jacket 10 is to be employed as a "boot" for shielding another elongate object. The wall thickness of outer member 12 is preferably from about 1–120 mils, and most preferably from about 3–25 mils, but also may be varied depending upon the requirements of the particular shielding application.

Materials suitable for forming outer member 12 may be selected from any of the known polymeric materials characterized as "heat-shrinkable" including: rubbers such as neoprene and silicone; oriented amorphous or crystalline thermoplastics including polyolefins such as polyethylene, polypropylene, polystyrene, and the like; vinyls such as polyvinyl chloride and polyvinyl acetate; polyamides; fluoropolymers such as polytetrafluoroethylene; polyesters such as polyethylene terephthalate; and copolymers and blends thereof In general, materials of such type may be cross-linked, oriented, or otherwise residually stressed into an expanded shape, but are sufficiently elastic to contract, constrict, or "shrink" to recover to a pre-expanded shape when raised to a predetermined temperature allowing intra-chain movement and the release of the residual stresses. For example, the material may inherently possess sufficient crystallinity to exhibit the desired thermal response, or may require cross-linking or the addition of another polymer or copolymer to exhibit the desired response. The "shrink" temperature should be above normal room temperature of about 25° C., and typically will be between about 95–225° C.

The tubular structure of the outer member 12 may be formed using conventional processing techniques. Typically, a melt of the heat-shrinkable material, which may be selected depending upon the service environment of the article to be shielded, is extruded through a die to form a continuous, generally tubular extrudate. The extrudate is cooled to a temperature, typically below about 100° F., which is below the crystalline melt temperature of the heat-shrinkable material. If cross-linking is required, conventional techniques again may be employed including irradiation with high energy electrons or by a chemical means such as through the addition of an organic peroxide. Alternatively, the tubular structure of the outer member 12 may be formed by extruding the heat-shrinkable material as a flat sheet, which sheet then is rolled into a tube and sealed along the seam.

The orientation of the tube, which may be effected prior to, during, or subsequent to the cross-linking, generally involves the stretching of the tube by at least about 25% and up to 100% or more in the transverse or radial direction. In this regard, the stress is applied in the transverse direction as axial shrinkage would result in undesirable lengthwise shrinkage of the tube upon subsequent heating. The manner of applying the stresses may entail, for example, forcing the tube over a mandrel having an outer diameter larger than the inner diameter of the tube. Alternatively, a pressure differential may be imposed relative to the inside and outside of the tube. The stretching may be effected either at ambient or elevated temperatures such as a temperature which is above the glass transition temperature of the heat-shrinkable material but below the melting, fusion, or degradation temperature thereof A preferred heat-shrinkable tube or sleeve for forming outer member 12 is sold commercially by Raychem Corp., Menlo Park, Calif., and by Sumitomo Corp., Japan.

Electrically-conductive inner member 14 preferably is provided as a pre-formed, generally tubular fabric or mesh sleeve which is woven, knitted, braided, or wound from a monofilament or multi-stranded fiber, wire, or yarn. The mesh or fabric, which may be of a single or multi-ply structure, is rendered electrically-conductive by reason of its being constructed of an electrically-conductive material, or alternatively, by reason of a later treatment such as plating or sputtering being applied to provide an electrically-conductive coating thereon. Electrically-conductive materials for forming outer member 18 include: carbon, graphite, and conductive polymer fibers; single or multiple strands of nonconductive, natural or synthetic fiber such as cotton, wool, silk, cellulose, polyester, polyamide, nylon, polyimide, or the like which have been coated with a conductive material such as a metal, carbon, or the like; and metal wires of copper, nickel, silver, aluminum, tin, or an alloy thereof. Preferred fibers include nylon or polyester yarns of from about 50–1200 denier which are plated with silver, copper, nickel, or tin, and especially silver-coated nylon yarns, e.g., 100–600 denier multi-fill nylon yarn having 20% by weight of silver plated thereon (Sauquoit Industries, Inc., Scranton, Pa.). Preferred metallic wires include silver-plated copper, nickel-clad copper, FERREX® (tin-plated, copper-clad steel wire, Chomerics Division of Parker-Hannifin Corp., Woburn, Mass.), aluminum, tin-clad copper, and phosphor bronze having a diameter of from about 1–100 mils, and especially a knitted Monel having a wire diameter of about 35 mils which is marketed commercially by the Chomerics Division of Parker-Hannifin Corp., Woburn, Mass., under the tradename MESH STRIP®. Knits of this general type are described further in U.S. Pat. Nos. 5,028,739 and 4,857,668.

Depending upon the needs of the specific application for jacket 10, inner member 14 alternatively may be provided as laminate of a nonconductive fabric and a conductive metal foil formed of copper, aluminum, or another metal, or as a combination or blend of conductive and nonconductive fibers. Examples of meshes and fabrics woven, braided, or warp knitted from electrically-conductive fibers, or from blends of conductive and nonconductive fibers, are described in Gladfelter, U.S. Pat. No. 4,684,762, and in Buonanno, U.S. Pat. No. 4,857,668. Such fabrics have a thickness of from about 1–10 mils, and are available in 300 and 100 denier varieties. A preferred fabric for inner member 14 is a polyester fabric with a nickel over copper plating.

In whatever form provided, inner member 14 functions both to confine any electromagnetic energy radiated by the conductor to within a specific volume, and to shield the conductor from external sources thereof. The electromagnetic energy is attenuated through its conversion into electrical energy in the form of bulk or surface currents which are induced within inner member 14. In this regard, an optional electrically-conductive ground wire, plane, or strip, which is referenced at 18 in FIGS. 2 and 4, may be disposed as extending in electrical contact with inner member 14 for dissipating the electrical energy developed therewithin.

Figure 2:
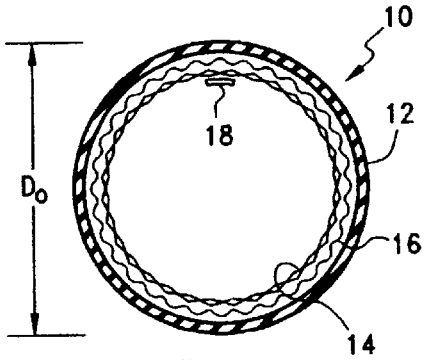
FIG. 2 is an enlarged cross-sectional view of the EMI shielding jacket of FIG. 1 taken through line 2—2 of FIG. 1, which line is perpendicular to the longitudinal axis of the jacket.

Thermoplastic interlayer 16 is interposed between inner and outer members 12 and 14 as a generally continuous layer of a heat-fusible, polymeric material for bonding the inner member to the outer member along substantially the entire length of the thereof. By "heat-fusible," it is meant that the polymeric material forming interlayer 16 exhibits the thermal response property of softening, melting, or otherwise reducing its viscosity to flow above a specified melting or other phase transition temperature. Preferably, interlayer 16 is incorporated within jacket 10 as a fibrous or film layer, which layer then may be heated and cooled for the consolidation of the jacket into an integral structure. For illustrative purposes, jacket 10 is shown in FIGS. 1 and 2 prior its consolidation into an integral structure, and in FIGS. 3–6 as having been consolidated subsequent to the heating and cooling of interlayer 16.

The thermoplastic polymeric material for forming interlayer 16 is selected as having a melting or other transition temperature which is above normal room temperature of about 25° C., but is below or not substantially above the shrink temperature of outer member 12. "Melting temperature" is used herein in its broadest sense to include a temperature or temperature range evidencing in the material a transition from a form-stable crystalline or glassy solid phase to a flowable liquid, semi-liquid, or otherwise viscous phase or melt which may be generally characterized as exhibiting intermolecular chain rotation. Preferred materials include 50–400 denier polyethylene, polypropylene, or Saran® monofilament or yarn, although other polyolefinic fibers or films, as well as other thermoplastic fibers or films formed of, for example, polyamides, polycarbonates, polyesters, polyvinyl acetates, or combinations, such as copolymers, blends, or mixtures, thereof may be substituted. Typically, such materials will exhibit melting temperatures of from about 70–95° C. An especially preferred material is a 300 denier, knitted polyethylene yarn which is sold commercially by Hercules Inc., Wilmington, Del.

Referring again to FIGS. 1 and 2, an embodiment of jacket 10 is illustrated wherein thermoplastic interlayer 16 is incorporated between inner and outer members 12 and 14 as a generally tubular, mesh or fabric sleeve which is sheathed over inner member 14. In this regard, electrically-conductive inner member 14 may be sleeved, knitted, woven, or braided over a mandrel (not shown), and then sleeved within a mesh, fabric, or film tube of thermoplastic interlayer 16. Interlayer 16, in turn, may be sleeved within outer member 12 to form the jacket structure shown in FIGS. 1 and 2. To facilitate the sleeving of interlayer 16 over inner member 14 and outer member 12 over interlayer 16, it is preferred that the outer diameters of the sleeves forming inner member 14 and interlayer 16 are selected as being a few mils less than, respectively, the inner diameters of interlayer 16 and outer member 12. Alternatively, interlayer 16 may be woven, knitted, braided, wound, or wrapped directly over inner member 14, with outer member 12 being wrapped or coated thereover. Although jacket 10 is shown in FIG. 2 as having a generally annular or circular cross-section, other geometries such as elliptical, polygonal, and the like are to be considered to be within the scope of the invention herein involved.

The thermal energy necessary for fusing interlayer 16 to consolidate jacket 10 into an integral structure may be supplied via either convective, conductive, or radiant transport mechanisms. For example, the jacket may be exposed to a stream of hot air or gas, or passed through a heated die to spot or continuously heat thermoplastic interlayer 16 which, upon cooling, solidifies to bond inner member 14 to outer member 12. Alternatively, infrared, microwave, inductive, or resistive heating may be used.

Figure 3:
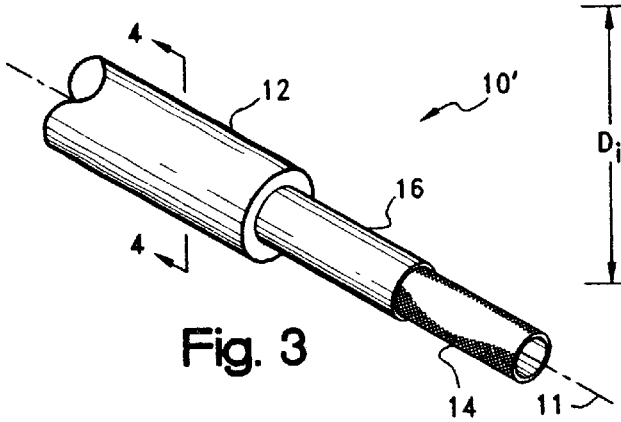
FIG. 3 is a perspective cut-a-way view of the EMI shielding jacket of FIG. 1 shown as having been heated to a temperature sufficient to melt the interlayer thereof and partially constrict the outer member thereby consolidating the jacket into an integral structure.
Figure 4:
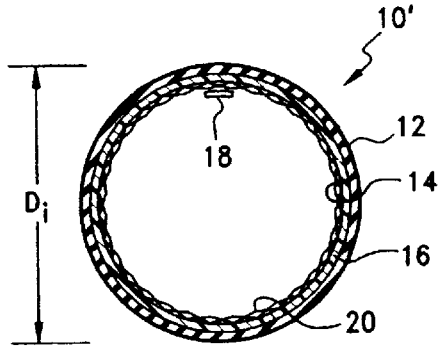
FIG. 4 is an enlarged cross-sectional view of the EMI shielding jacket of FIG. 3 taken through line 4—4 of FIG. 3, which line is perpendicular to the longitudinal axis of the jacket.

Looking next to FIGS. 3 and 4, jacket 10 is shown at 10' as having been consolidated into an integral structure following the fusing and resolidification of thermoplastic interlayer 16. By "consolidated," it is meant that inner and outer members 14 and 12 of jacket 10' are bonded together by the thermoplastic interlayer thereof Depending upon, for example, the melt viscosity of the material forming thermoplastic interlayer 16, such interlayer may permeate through inner member 14. It is preferred, however, that the interior, 20, of inner member 14 remains exposed as is shown in FIG. 4 to provide an electrically-conductive surface for contact with ground plane 18. Notwithstanding whether or not interlayer 16 diffuses completely through inner member 14, consolidation is achieved effective such that when jacket 10' is sectioned or otherwise terminated to length, electrically-conductive inner member 14 exhibits substantially no splay or unravel as has been observed in the jackets heretofore known in the art. Such consolidation is to be contrasted with the mere bonding of the inner and outer members as would realized with a pressure sensitive adhesive or the like.

Figure 6:
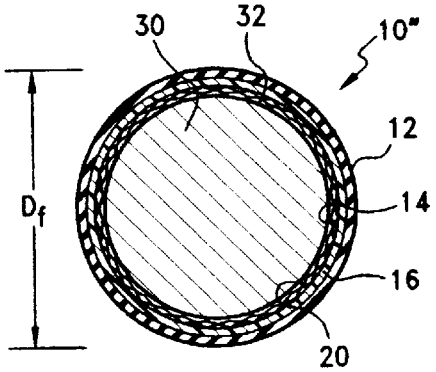
FIG. 6 is an enlarged cross-sectional view of the EMI shielding jacket of FIG. 5 taken through line 6—6 of FIG. 5, which line is perpendicular to the longitudinal axis of the jacket.

Advantageously, depending upon the respective shrink and melt temperatures of outer member 12 and interlayer 16, the heating of jacket 10 fusing interlayer 16 is effective to partially constrict outer member 12 to an inner diameter, referenced generally at $D_i$ in FIG. 4, which is intermediate the final recovered or contracted diameter $D_f$ thereof (FIG. 6). The partial contraction of outer member 12 advantageously exerts a generally radially compressive force on inner member 14, which force further consolidates jacket 10, into an integral structure.

Turning lastly to FIGS. 5 and 6, jacket 10' is shown at 10" as having been further radially contracted or "shrunk" over an electrical wire or cable, 30, which additionally may have an electrically-insulating, dielectric outer covering (not shown). In this regard, jacket 10' may be sleeved or otherwise sheathed over wire 30 or a like elongate object, and then heated to a temperature which is above the heat-shrink temperature of outer member 12. As before, thermal energy may be supplied, for example, by exposing the jacket to a stream of heated gas or air, passing the assembly through a heated die, or using infrared, microwave, inductive, or resistive heating techniques. By whatever transport mechanism the thermal energy is supplied, the heating of the jacket is effective to radially contract outer member 12 for its recovery to a final inner diameter, referenced at $D_f$ in FIG. 6, which is smaller than its expanded or intermediate diameters, $D_o$ and $D_i$, respectively. The contracting of outer member 12 to its contracted inner diameter $D_f$ advantageously functions to uniformly conform jacket 10" to the outer diametric extent, referenced at 32, of wire 30. Accordingly, an EMI shielding jacket is provided which presents a uniform shielding surface along substantially the entire lengthwise extent thereof, and which is resistant to cracking, crazing, and other modes of mechanical failure.

The Examples to follow are illustrative of the practicing of the invention herein involved, but should not be construed in any limiting sense.

EXAMPLES

Example 1

An experiment was conducted to confirm the feasibility of the precepts of the present invention. A 0.25 inch diameter, electrically-conductive tube (MESH STRIP®, Chomerics Division of Parker-Hannifin Corp., Woburn, Mass.) knitted of a 0.0035 inch diameter Monel wire was sleeved over a 0.25 inch diameter mandrel. Over the wire tube was sleeved a 0.26 inch diameter thermoplastic tube (Hercules Inc., Wilmington, Del.) knitted of a 300 denier polypropylene yarn. A 0.375 inch diameter, heat-shrinkable polyolefin tube (Raychem Corp., Menlo Park, Calif.) having a wall thickness of about 0.012 inch was sleeved over the thermoplastic tube. The assembly was heat using a heat gun to a temperature of about 180° C. sufficient to fuse the thermoplastic tube and to partially constrict the heat-shrinkable outer tube. Upon the sectioning of the jacket so formed, it was observed that the thermoplastic tube had melted sufficient to bond the heat-shrinkable tube to the electrically-conductive tube, thereby uniformly consolidating the jacket into an integral structure. No unravel or splay of the electrically-conductive tube was evident at the cut end of the jacket.

Example 2

The resistance of a sample of the jacket of Example 1 was measured using a 4-lead ohm meter. It was observed that the surface resistivity of the sample, which was measured to be about 0.200–0.010 Ω/cm compared favorably with the resistance of about 0.05 Ω/cm exhibited by a commercial heat-shrinkable EMI shielding product ("CHO-SHRINK™," Chomerics Division of Parker-Hannifin Corp., Woburn, Mass.). Thus, it was concluded that the jacket of the present invention should exhibit acceptable EMI shielding properties, while additionally having a simplified, more robust construction which is economical to manufacture and which exhibits improved mechanical properties for more consistent EMI shielding performance.

Example 3

A length of the jacket of Example 2 was sleeved over a 0.150 inch diameter, insulated cable comprising a bundle of 21 individual copper wires. The jacket was heated with a heat gun to a temperature of about 180° C. sufficient to further shrink the outer tube. The jacket was observed to uniformly conform to the outer diametric extent of the cable.

As it is anticipated that certain changes may be made in the present invention without departing from the precepts herein involved, it is intended that all matter contained in the foregoing description shall be interpreted as illustrative and not in a limiting sense. All references cited herein are expressly incorporated by reference.

What is claimed:

1. A heat-shrinkable electromagnetic interference (EMI) shielding jacket sheathable over a generally elongate object of a given outer diameter extent, said jacket comprising:

a tubular outer member of an indefinite length and an expanded inner diameter which is greater than the outer diameter of the object, said outer member being heat-shrinkable to a recovered inner diameter smaller than said expanded inner diameter substantially conforming said jacket to the outer diametric extent of the object;

an electrically-conductive, tubular inner member received coaxially within said outer member and extending coextensive therewith; and a generally continuous, thermoplastic interlayer interposed between said outer and inner members and extending coextensive therewith, said interlayer bonding said inner member to said outer member along substantially the entire length thereof for consolidating said jacket into an integral structure, wherein said tubular outer member is partially constricted about said inner member to a diameter intermediate said expanded and recovered diameters for exerting a generally radially compressive force on said inner member further consolidating said jacket into said integral structure.

2. The EMI shielding jacket of claim 1 wherein said inner member is constructed as an electrically-conductive mesh or fabric.

3. The EMI shielding jacket of claim 2 wherein said mesh or fabric is woven, A knitted, braided, or wound of an electrically-conductive material selected from a group consisting of: cotton, wool, silk, cellulose, polyester, polyamide, nylon, and polyamide fibers coated with copper, nickel, silver, aluminum, tin, carbon, graphite, or a combination thereof; copper, nickel, silver, aluminum, bronze, Monel, and tin wire; carbon, graphite, and conductive polymer fibers; and combinations thereof.

4. The EMI shielding jacket of claim 1 wherein said interlayer is formed of a thermoplastic material selected from a group consisting of polyolefins, polyamides, polycarbonates, polyesters, polyvinyl acetate, and copolymers and blends thereof.

5. The EMI shielding jacket of claim 1 wherein said outer member is formed of a heat-shrinkable polymeric material selected from a group consisting of rubbers, polyolefins, polyesters, vinyls, polyamides, fluoropolymers, polyacrylates, and copolymers and blends thereof.

* * * * *